US012350539B2

(12) United States Patent
Sasano

(10) Patent No.: US 12,350,539 B2
(45) Date of Patent: Jul. 8, 2025

(54) WEIGHT LOADING APPARATUS FOR FOOT AND LEG EXERCISES

(71) Applicant: Kensui LLC, Sheridan, WY (US)

(72) Inventor: Remy Sasano, Osaka (JP)

( * ) Notice: Subject to any disclaimer, the term of this patent is extended or adjusted under 35 U.S.C. 154(b) by 55 days.

(21) Appl. No.: 18/325,513

(22) Filed: May 30, 2023

(65) Prior Publication Data

US 2023/0381571 A1 Nov. 30, 2023

Related U.S. Application Data

(60) Provisional application No. 63/346,917, filed on May 30, 2022, provisional application No. 63/389,925, filed on Jul. 17, 2022.

(51) Int. Cl.

| | |
|---|---|
| ***A63B 21/065*** | (2006.01) |
| ***A63B 21/00*** | (2006.01) |
| ***A63B 21/072*** | (2006.01) |
| ***A63B 23/08*** | (2006.01) |
| ***A63B 23/10*** | (2006.01) |

(52) U.S. Cl.

CPC ..... *A63B 21/065* (2013.01); *A63B 21/0728* (2013.01); *A63B 21/4013* (2015.10); *A63B 21/4015* (2015.10); *A63B 23/08* (2013.01); *A63B 23/10* (2013.01); *A63B 2225/09* (2013.01)

(58) Field of Classification Search

CPC ..... A63B 21/065; A63B 21/0728; A63B 21/4013; A63B 23/08; A63B 23/10; A63B 2225/09; A63B 21/4011–4015; A63B 21/06–075

See application file for complete search history.

(56) References Cited

U.S. PATENT DOCUMENTS

| | | | | | |
|---|---|---|---|---|---|
| 1,990,970 | A * | 2/1935 | Wood | A43B 19/005 | 36/132 |
| 2,114,790 | A * | 4/1938 | Venables | A63B 21/4001 | 482/79 |
| 2,214,052 | A * | 9/1940 | Good | A63B 21/4015 | 482/79 |
| 2,733,065 | A * | 1/1956 | Barkschat | A63C 17/20 | 482/79 |
| 3,343,836 | A * | 9/1967 | James, Jr. | A63B 21/065 | 482/79 |
| D264,736 | S * | 6/1982 | Wolf | D21/683 | |
| 4,964,631 | A * | 10/1990 | Marano | A63B 21/4013 | 482/93 |
| 5,169,364 | A * | 12/1992 | Donaldson | A63B 21/065 | 482/148 |
| 5,176,595 | A * | 1/1993 | Lind | A63B 22/20 | 482/148 |
| 5,722,919 | A * | 3/1998 | Timmer | A63B 23/08 | 482/79 |
| 9,868,014 | B1 * | 1/2018 | Lake | A63B 21/4034 | |
| 10,583,323 | B2 * | 3/2020 | Little | A63B 21/4015 | |

(Continued)

*Primary Examiner* — Nyca T Nguyen
(74) *Attorney, Agent, or Firm* — Michael D. Eisenberg

(57) ABSTRACT

A weight loading apparatus is provided, comprising a base, a fastener unit, at least one rod, and a locking unit. The base is configured to be placed under a user's foot or footwear. The fastener unit is joined to the base and configured to secure the base to the foot. The at least one rod is joined to the base and configured to be traversed by a perforated weight plate. The locking unit is configured to removably lock the weight plate to the rod.

7 Claims, 31 Drawing Sheets

(56) References Cited

U.S. PATENT DOCUMENTS

| | | | | |
|---|---|---|---|---|
| 10,881,895 | B2 * | 1/2021 | Gubera | A63B 23/04 |
| 11,904,204 | B2 * | 2/2024 | Tarkington | A63B 23/03508 |
| 2002/0119872 | A1 * | 8/2002 | Greenheck | A63B 21/4015 482/106 |
| 2008/0293550 | A1 * | 11/2008 | Campbell | A63B 26/00 482/121 |
| 2009/0131233 | A1 * | 5/2009 | Seitzer | A63B 21/4015 482/105 |
| 2009/0192025 | A1 * | 7/2009 | Minerva | A63B 21/4017 482/93 |
| 2010/0050477 | A1 * | 3/2010 | Zeek | A63B 21/0004 36/132 |
| 2012/0025479 | A1 * | 2/2012 | Zeek | A63B 21/4015 280/11.31 |
| 2012/0028766 | A1 * | 2/2012 | Zeek | A63C 17/262 482/105 |
| 2012/0028767 | A1 * | 2/2012 | Zeek | A63B 21/4015 482/105 |
| 2012/0088640 | A1 * | 4/2012 | Wissink | A63B 21/4015 482/110 |
| 2013/0040788 | A1 * | 2/2013 | Booker | A63B 21/4015 482/106 |
| 2015/0335935 | A1 * | 11/2015 | Peralo | A63B 21/012 482/93 |
| 2017/0216651 | A1 * | 8/2017 | Weber | A63B 21/00061 |
| 2018/0099174 | A1 * | 4/2018 | Biggs | A63B 21/065 |
| 2019/0308056 | A1 * | 10/2019 | Gubera | A63B 21/0004 |
| 2023/0330470 | A1 * | 10/2023 | Theofilos, Md | A63B 22/20 |
| 2023/0381571 | A1 * | 11/2023 | Sasano | A63B 23/10 |
| 2024/0278065 | A1 * | 8/2024 | McLean | A63B 21/4034 |

* cited by examiner

WEIGHT LOADING APPARATUS FOR FOOT AND LEG EXERCISES

CROSS-REFERENCE TO RELATED APPLICATIONS

This application claims priority from U.S. Provisional Application Ser. No. 63/346,917 filed on May 30, 2022, and from U.S. Provisional Application Ser. No. 63/389,925, filed on Jul. 17, 2022, both of which are hereby incorporated herein by reference in their respective in entirety.

BACKGROUND OF THE INVENTION

This invention relates to exercising equipment, and more specifically (but not limited to) to exercising equipment for weight training.

In fitness equipment, ankle weights are used for joining weights to a user's ankles to enable the user to perform exercises by moving the user's legs, to stimulate desired muscles.

Current ankle weights are extremely bulky and only allow customized weights or sandbags to increase the weight of the ankle weight. Therefore, the ankle weight is not portable unless the customized weights are carried too. Furthermore, adding and removing weight can be cumbersome, since the weight-carrying pockets in the generally the smallest increments of the customized weights are around 3 lbs. Therefore, adding large weight requires adding many customized weights, which is time-consuming and makes the ankle weight device cumbersome.

BRIEF SUMMARY OF EMBODIMENTS OF THE INVENTION

An aim of the present of the present invention is to provide a weight loading device that attaches weight plates (such as standard Olympic weights) to a shoe or foot. This enables large compact weights to be used instead of cumbersome and uncomfortable ankle weights known in the art.

Therefore, an aspect of some embodiments of the present invention relates to a weight loading apparatus, comprising a base, a fastener unit, at least one rod, and a locking unit. The base is configured to be placed under a user's foot or footwear. The fastener unit is joined to the base and configured to secure the base to the foot. The at least one rod is joined to the base and configured to be traversed by a perforated weight plate. The locking unit is configured to removably lock the weight plate to the rod.

In a variant, the fastener unit is adjustable so that the base is joined to any desired portion of the foot or footwear, from a plurality of choices.

In another variant, the rod is hollow and has first threading in an inner surface thereof. The locking unit comprises a screw having second threading matching the first threading and a head larger than a perforation of the weight plate, such that the screw is configured to enter the hollow rod and lock the weight plate between the base and the head of the screw.

In yet another variant, the rod is threaded on an outer surface thereof. The locking unit comprises a nut having a threaded hole configured to cooperate with the threaded rod, the nut being larger than a perforation of the weight plate, such that the nut is configured to be screwed on the rod and to lock the weight plate between the base and the nut.

In a further variant, the locking unit comprises one of: a spin-lock, a lockjaw, a barbell collar, and a barbell clip.

In some embodiments of the present invention, the rod is removably joined to the base.

In a variant, the base comprises at least one hole. The rod comprises a hollow binding bolt having a threaded inner surface. The locking unit comprises a screw having threading configured to cooperate with the threaded inner surface of the binding bolt, the screw having a screw head larger than a perforation of the weight plate. The binding bolt is configured to traverse the hole from a side of the base facing the shoe or foot of the user, the biding bolt having a bolt head that is larger than the hole. The screw is configured to enter the binding bolt and lock the weight plate between the base and the screw head.

In another variant, the base comprises at least two holes.

In some embodiments of the present invention, the base comprises a foot rest configured to be located below the user's foot or shoe, and a heel holder configured contact a heel of the user or a rear end of the user's footwear, when the user's foot or footwear is on the foot rest.

In a variant, a location of the heel holder along the foot rest is adjustable.

In another variant, the heel holder is removably joined to the foot rest.

In yet another variant, the rod is joined to a surface of the foot rest.

In a further variant, the rod is joined to the heel holder.

In some embodiments of the present invention, the base has an upper surface and a lower surface, the upper surface being configured to face the foot of the user when the apparatus is worn by the user. The base comprises a pair of side extensions extending upward from the base, each extension having a first end joined to the base and a second end located above a foot rest of the base, such that when the apparatus is worn, the second ends are located at opposite sides of an ankle of the user. The rod comprises at least two separate rods, each of the separate rods being joined the second end of a respective hub and extending outward from the respective hub. The locking unit comprises at least two separate locking units configured to removably lock respective weight plates onto the separate rods.

In a variant, the rods are hollow, and have openings at the extensions. The apparatus comprises padded caps configured to be inserted into the openings, so that padding of the padded caps faces inwardly from the respective extensions.

In another variant, each of the separate rods is hollow and has first threading in an inner surface thereof. Each of the locking units comprises a screw having second threading matching the first threading and a head larger than a perforation of the respective weight plate, such that the screw is configured to enter the hollow rod and lock the weight plate between the base and the head of the screw.

In yet another variant, each screw is partially hollow, with an aperture at the screw head.

In a further variant, the apparatus includes a connector shaft to connect the apparatus to a second weight loading apparatus. The connector shaft has two ends, each configured to be inserted into a respective screw head via the aperture on the screw head.

The connector shaft may have an adjustable length.

In yet a further variant, the connector shaft comprises a first piece and a second piece, the first piece being insertable into the second piece and movable with respect to the second piece, to change the length of the connector shaft.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
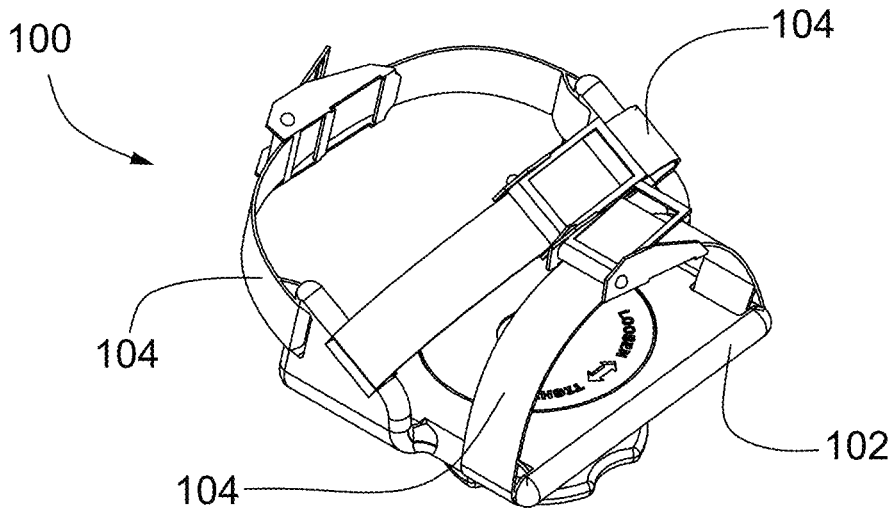
FIG. 1 is a perspective view of a weight loading apparatus having hollow rod and screw, according to some embodiments of the present invention.
Figure 2:
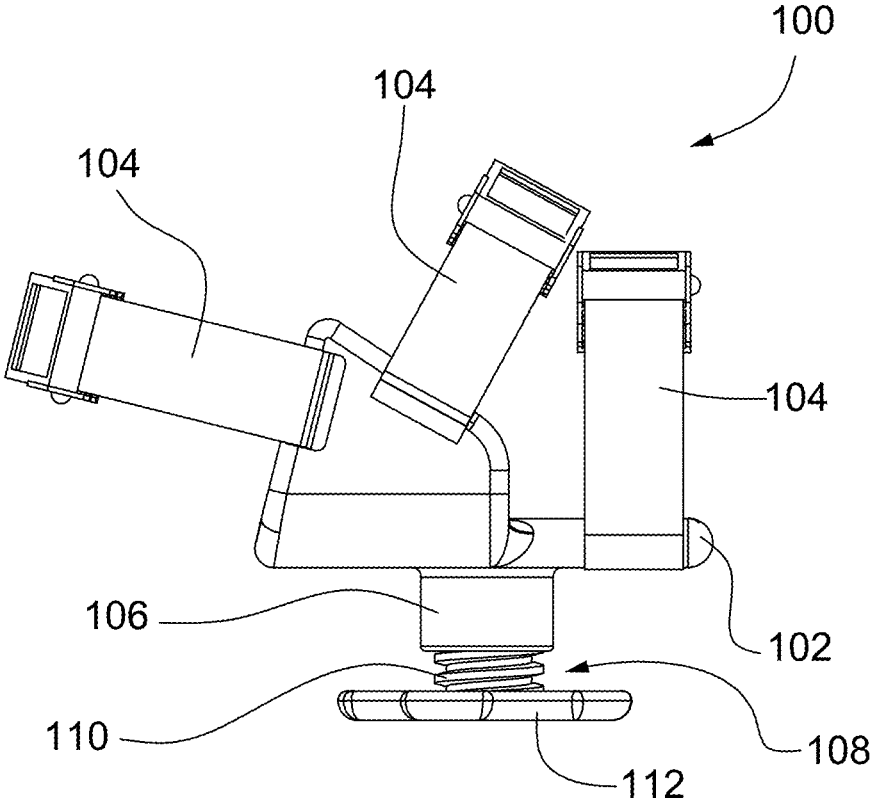
FIG. 2 is a side view of the weight loading apparatus of FIG. 1.
Figure 3:
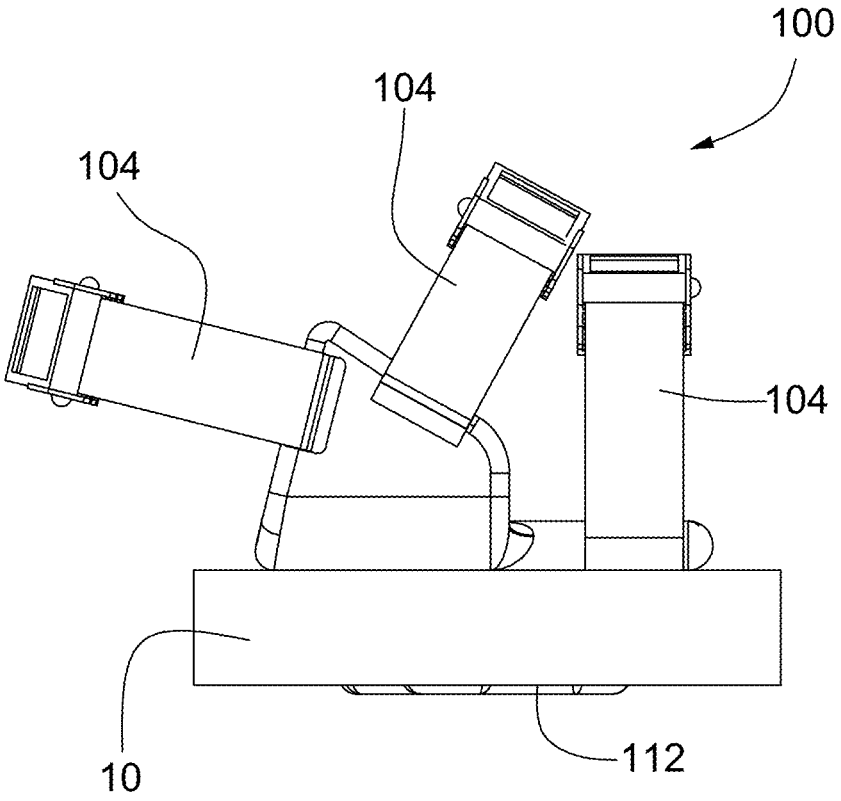
FIG. 3 is a side view of the weight loading apparatus of FIG. 1, with a weight plate locked to the weight loading apparatus.
Figure 4:
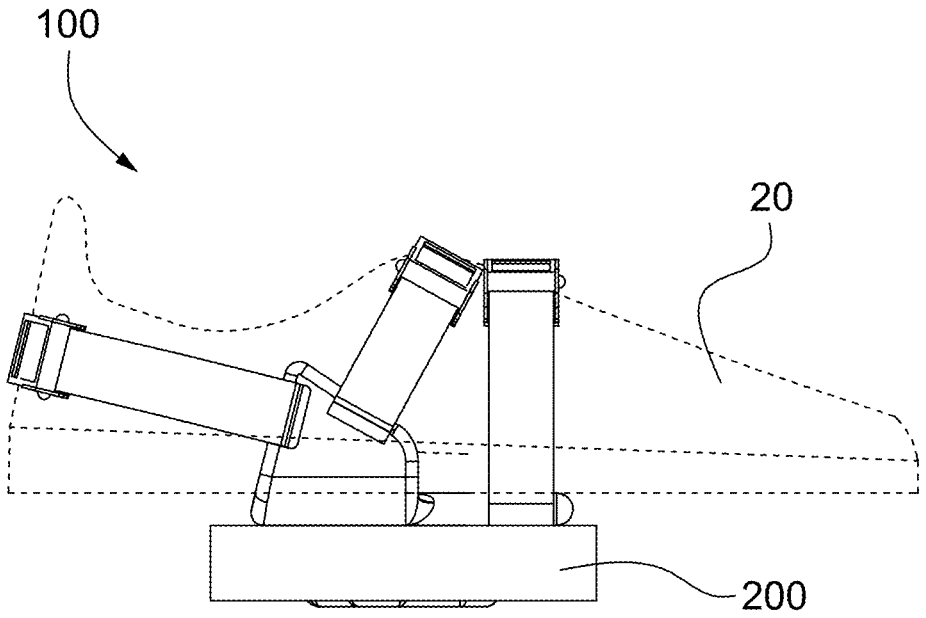
FIG. 4 illustrates the weight loading apparatus of FIG. 1 joined to a user's shoe.

Referring now to the drawings, FIG. 1 is a perspective view of a weight loading apparatus having hollow rod and screw, according to some embodiments of the present invention. FIG. 2 is a side view of the weight loading apparatus of FIG. 1. FIG. 3 is a side view of the weight loading apparatus of FIG. 1, with a weight plate locked to the weight loading apparatus. FIG. 4 illustrates the weight loading apparatus of FIG. 1 joined to a user's shoe.

The weight loading apparatus 100 includes a base 102, fastener unit 104, at least one rod 106, and a locking unit 108.

The base 102 is configured to be placed under a user's foot (directly, or with footwear 20 between the base and the foot). The fastener unit 104 is joined to the base 102 and is configured to secure the base 102 to the foot or footwear 20. The fastener unit may include straps, strings, laces, or any other unit configured to secure the base to the foot or footwear. The rod 106 is joined to the base 102 and configured to be traversed by a perforated weight plate 10. The locking unit 108 is configured to removably lock the weight plate 10 to the rod 106.

In the example of FIGS. 1-4, the rod 102 is hollow and has first threading (not shown) in an inner surface thereof. The locking unit 108 comprises a screw having second threading 110 matching the first threading and a head 112 larger than a perforation of the weight plate 10, such that the screw 108 is configured to enter the hollow rod and lock the weight plate 10 between the base 102 and the head 112 of the screw 108.

Figure 5:
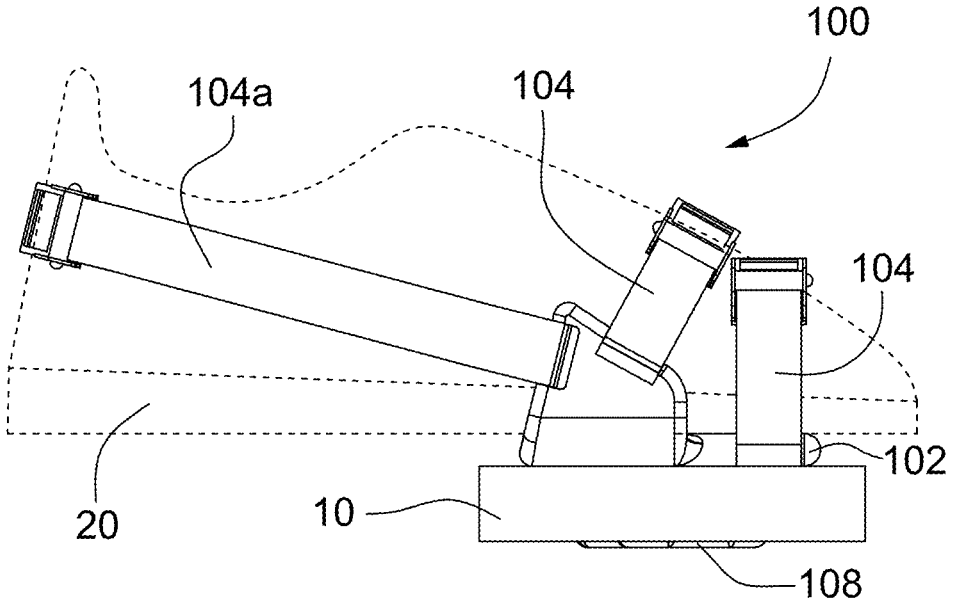
FIG. 5 illustrates a weight loading apparatus with adjustable fastener unit, according to some embodiments of the present invention.

FIG. 5 illustrates a weight loading apparatus with adjustable fastener unit, according to some embodiments of the present invention.

The fastener unit 104 is adjustable so that the base is joined to any desired portion of the foot or footwear, from a plurality of choices. In FIG. 5, the fastener unit includes a plurality of straps having an adjustable length to allow a desired distribution of the weight along the foot.

In the example of FIG. 5, the rear strap 104*a* is lengthened so the weight 10 can be placed more toward the front of the shoe 20, compared to FIGS. 3 and 4. In this manner, certain exercises, such as a tibia raise, can be performed. In the tibia raise, the user lifts the toes towards your knees, hinging at the ankles and then lowers the toes back down. Having the weight closer to the toes increases the torque needed by the user to move the foot in this manner and therefore causes the tibialis anterior muscle to work harder.

Figure 6:
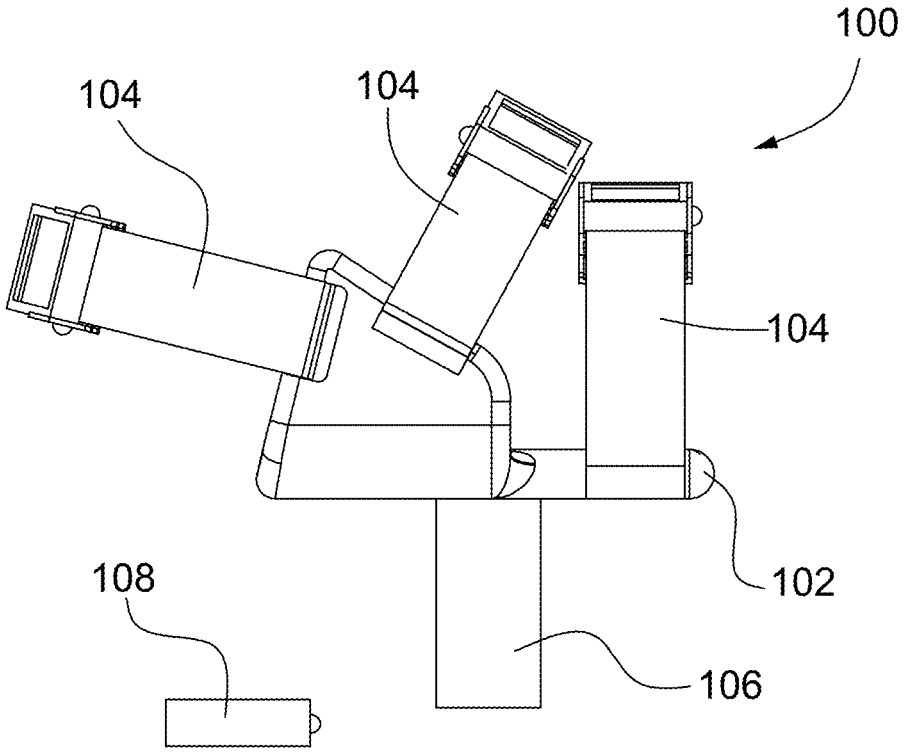
FIG. 6 illustrates a weight loading apparatus wherein the locking unit comprises one of a spin-lock, a lockjaw, a barbell collar, and a barbell clip, according to some embodiments of the present invention.
Figure 7:
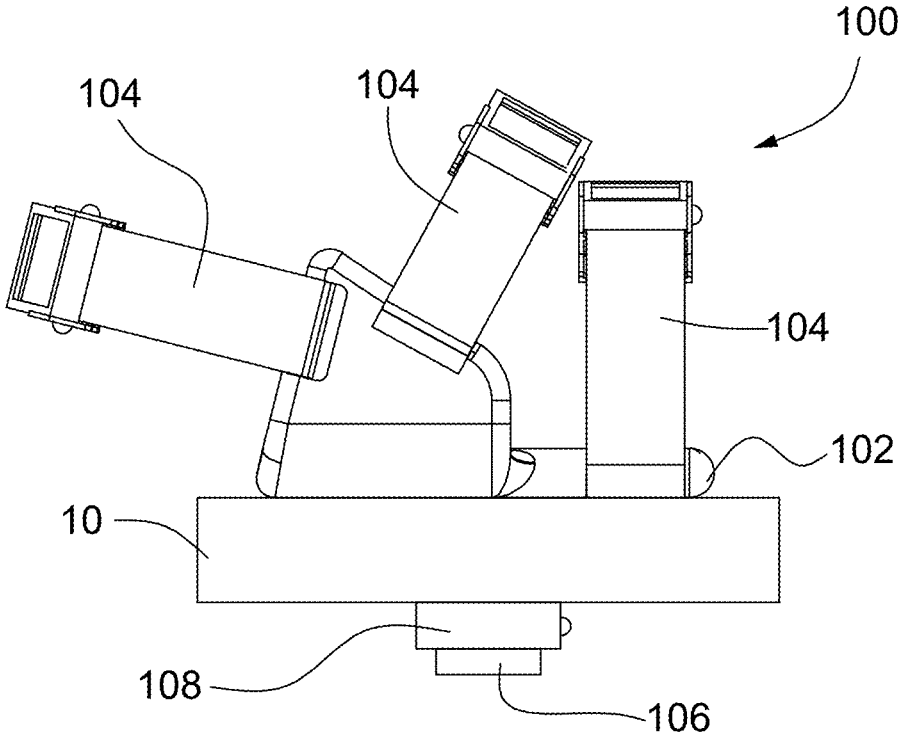
FIG. 7 illustrates the weight loading apparatus of FIG. 6 with a weight plate attached, according to some embodiments of the present invention.

FIG. 6 illustrates a weight loading apparatus wherein the locking unit comprises one of a spin-lock, a lockjaw, a barbell collar, and a barbell clip, according to some embodiments of the present invention. FIG. 7 illustrates the weight loading apparatus of FIG. 6 with a weight plate attached, according to some embodiments of the present invention.

In the weight loading apparatus 100 of FIGS. 6 and 7, locking unit 108 is designed to apply a radial force of the outer surface of the rod 104 in order to retain the weight plate 10 on the rod between the base 102 and the locking unit 108. Non-limiting examples of such a locking unit 108 are a spin-lock, a lockjaw, a barbell collar, and a barbell clip.

Figure 8:
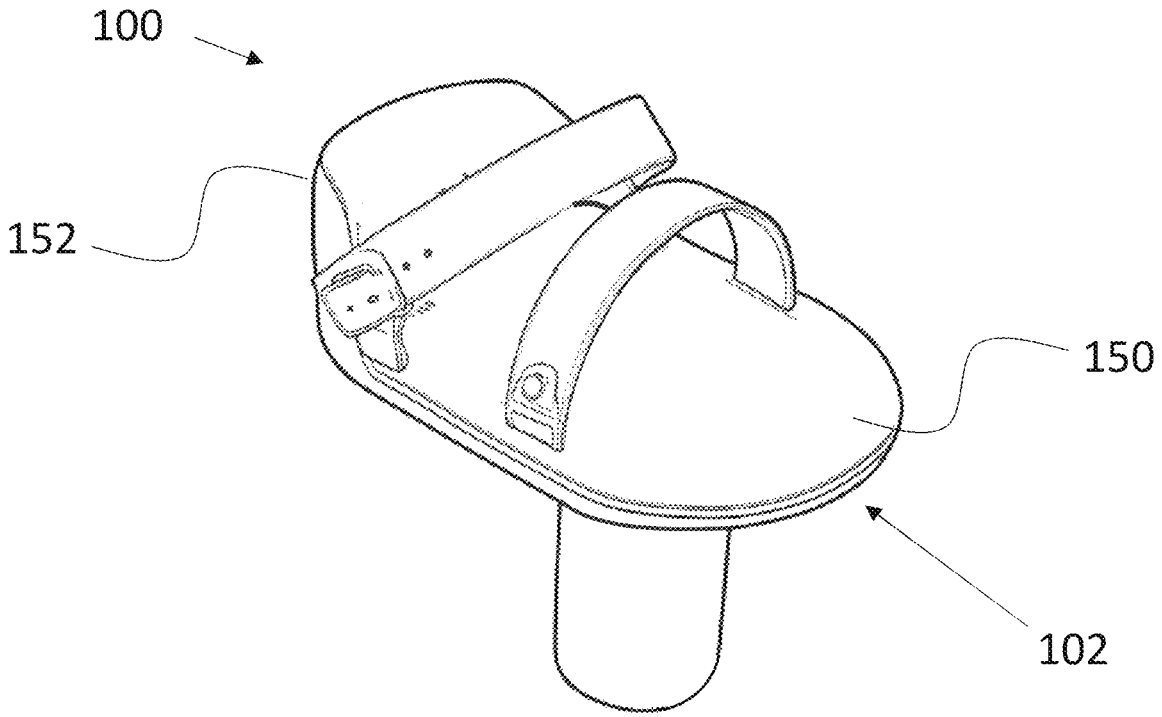
FIG. 8 illustrates a weight loading apparatus having a heel holder, according some embodiments of the present invention.

FIG. 8 illustrates a weight loading apparatus 100 having a heel holder, according to some embodiments of the present invention.

In the example of FIG. 8, the base 102 includes a foot rest 150 and a heel holder 152. The foot rest 150 is configured to be located below the user's foot or shoe. The heel holder 152 is located at the rear section of the foot rest 150 and contact a heel of the user or a rear end of the user's footwear, when the user's foot or shoe is on the foot rest.

Figure 9:
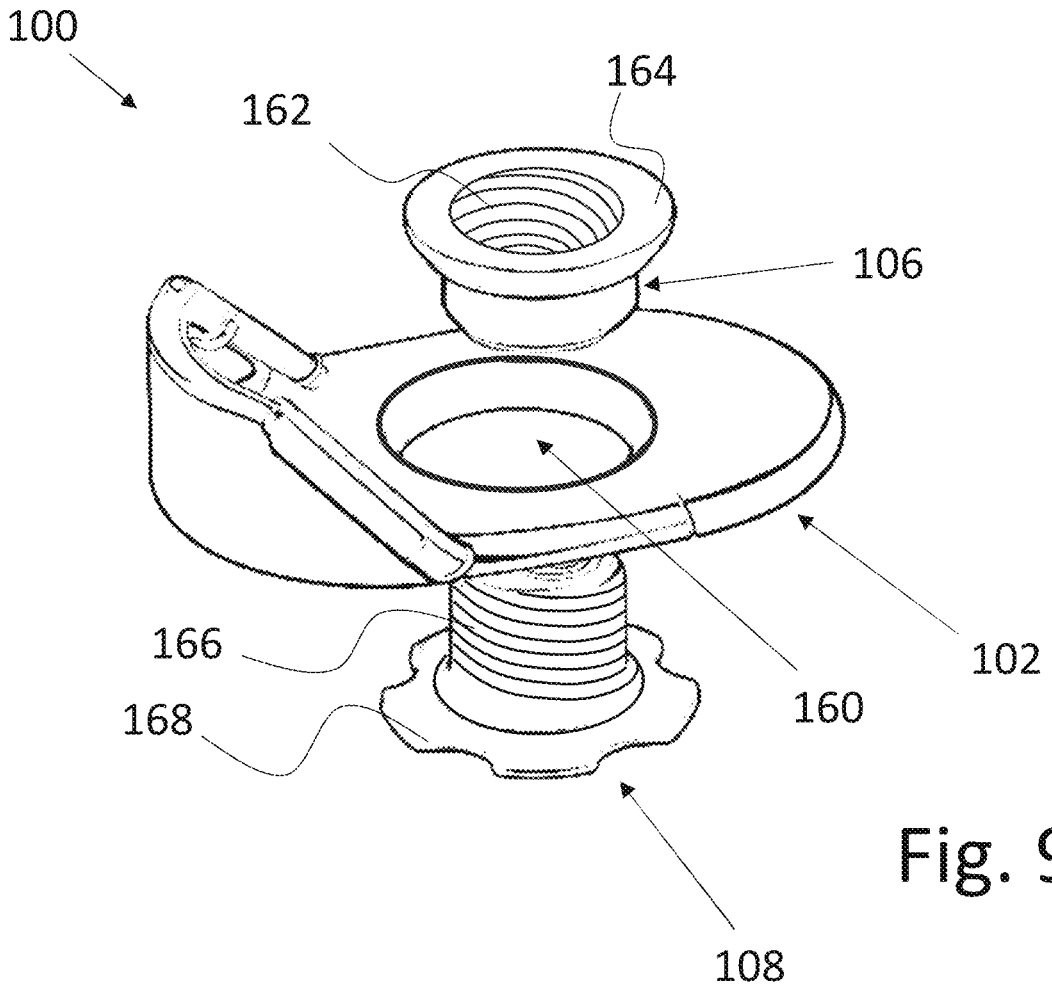
FIG. 9 is an exploded view of a weight loading apparatus with a binding-bolt-and-screw device, according to some embodiments of the present invention.
Figure 10:
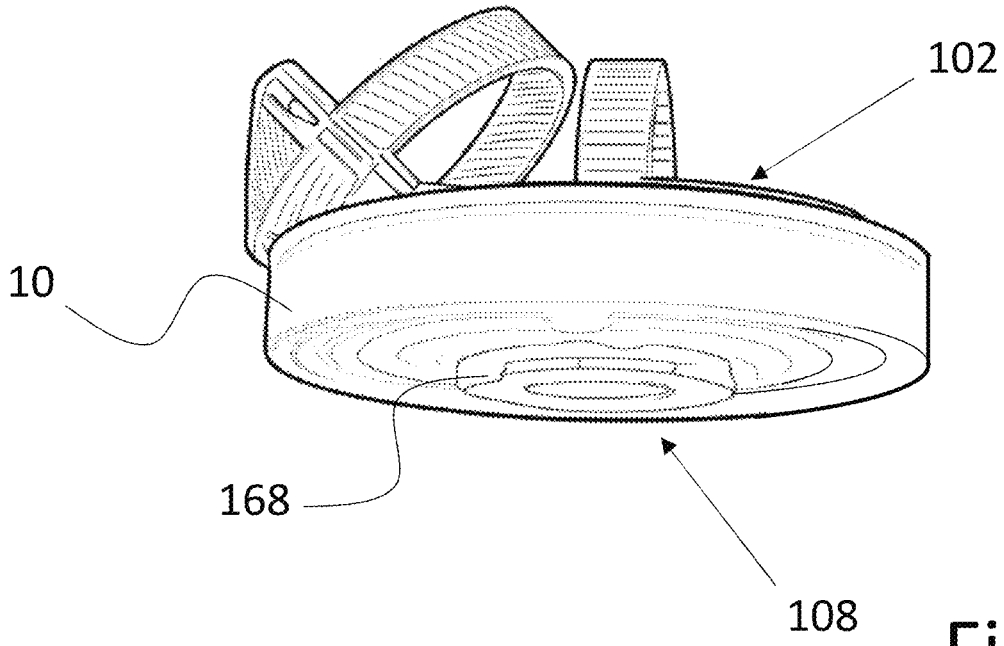
FIG. 10 illustrates the weight loading apparatus of FIG. 9, joined to a plate weight.

FIG. 9 is an exploded view of a weight loading apparatus with a binding-bolt-and-screw device, according to some embodiments of the present invention. FIG. 10 illustrates the weight loading apparatus of FIG. 9, joined to a plate weight.

In some embodiments of the present invention, the rod is removably joined to the base 102. An advantage of this lies in the fact that the rod may be removed so that the weight loading apparatus is more compact when stored. Another advantage of this lies in the fact that rods of different widths may be joinable to the base, so as to match perforations of different types of weight plates.

In, a non-limiting example, the base the base comprises at least one hole 160, while the removable rod 106 and locking unit 108 form a binding-bolt-and-screw device. The rod 106 includes a hollow binding bolt having a threaded inner surface 162 and a bolt head 164 that is larger than the hole 160. The locking unit 108 includes a screw having threading 166 configured to cooperate with the threaded inner surface 162 of the binding bolt. The screw has a screw head 168 larger than a perforation of the weight plate 10.

The binding bolt is configured to traverse the hole 160 from a side of the base 102 facing the shoe or foot of the user, so the bolt head 164 does not traverse the hole 160 (as the bolt head is larger than the hole 160). The screw is configured to enter the binding bolt and lock the weight plate 10 between the base and the screw head.

In another embodiment of the present invention, the rod includes the screw and the locking unit includes the bolt. In such an embodiment, the screw traverses the hole 106 from a side of the base 102 facing the shoe or foot of the user, and cooperates with the binding bolt below the base (on a side of the base that faces away from the user's shoe or foot). The bolt head is larger than the perforation of the weight plate. The screw head is larger than the hole 160.

It should be noted that in the examples of FIGS. 9 and 10, the base includes a heel holder. This feature is optional, and the structure and functionality of binding-bolt-and-screw device remain the same, whether the heel holder is present or not.

Figure 11:
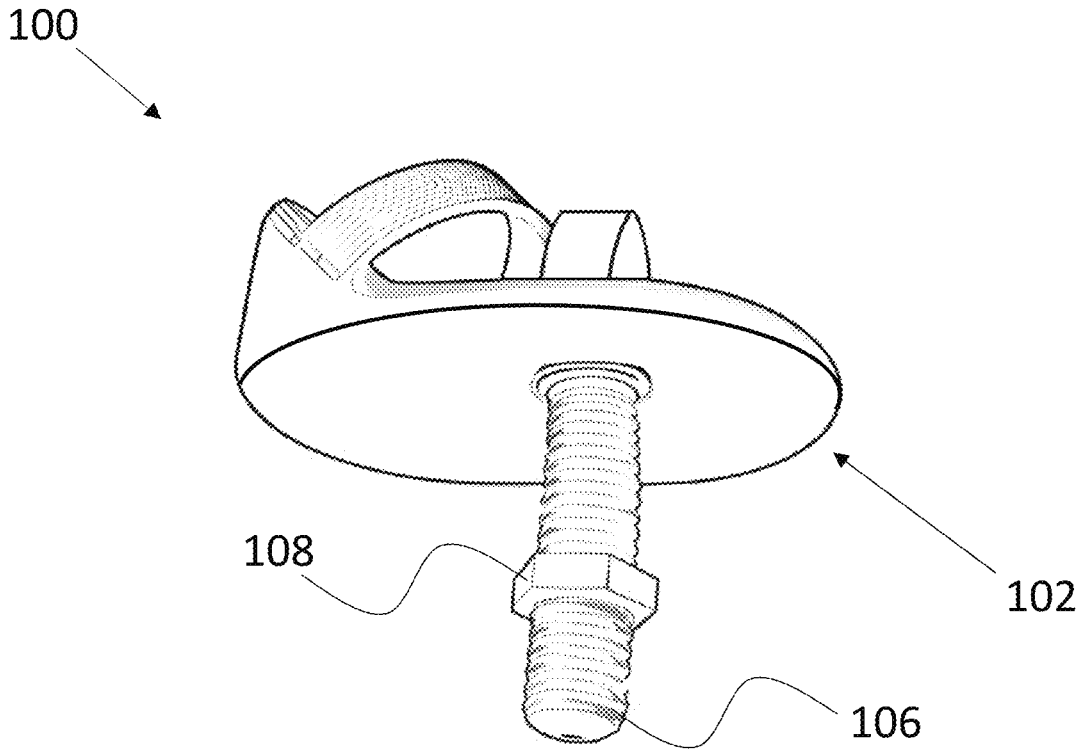
FIG. 11 illustrates is a weight loading apparatus with a threaded rod, according to some embodiments of the present invention.
Figure 12:
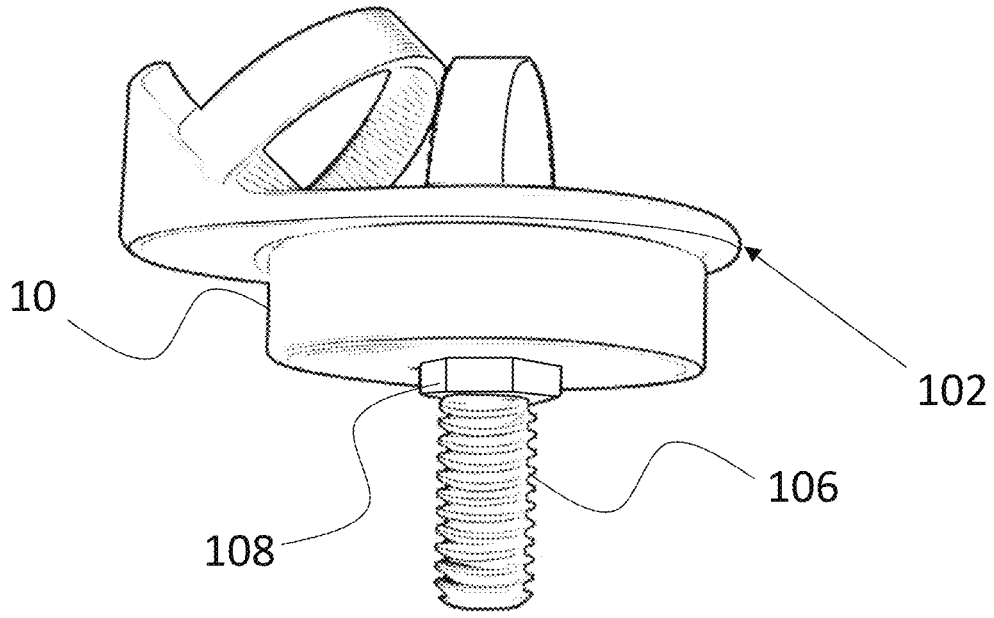
FIG. 12 illustrates the weight loading apparatus of FIG. 11, joined to a plate weight.

FIG. 11 illustrates a weight loading apparatus with a threaded rod, according to some embodiments of the present invention. FIG. 12 illustrates the weight loading apparatus of FIG. 11, joined to a plate weight.

In some embodiments of the present invention, the rod 104 is threaded on an outer surface thereof.

The locking unit 108 comprises a nut having a threaded hole configured to cooperate with the threaded rod 104. The nut is larger than a perforation of the weight plate 10, such that the nut is configured to be screwed on the rod 104 and to lock the weight plate 10 between the base 102 and the nut 108.

In some embodiments of the present invention, at least two holes may be present at respective locations along the back-to-front length of the foot rest, to enable the user to select a desired hole for placement of the weight plate at a location that is more desirable for a selected exercise. For example, a hole closer to the front would be more desirable for performing tibia raises, as discussed above. A non-limiting example of a foot rest with two holes can be found, for example, in FIG. 14.

It should be noted that in the examples of FIGS. 11 and 12, the base includes a heel holder. This feature is optional, and the structure and functionality of binding-bolt-and-screw device remain the same, whether the heel holder is present or not.

Figure 13:
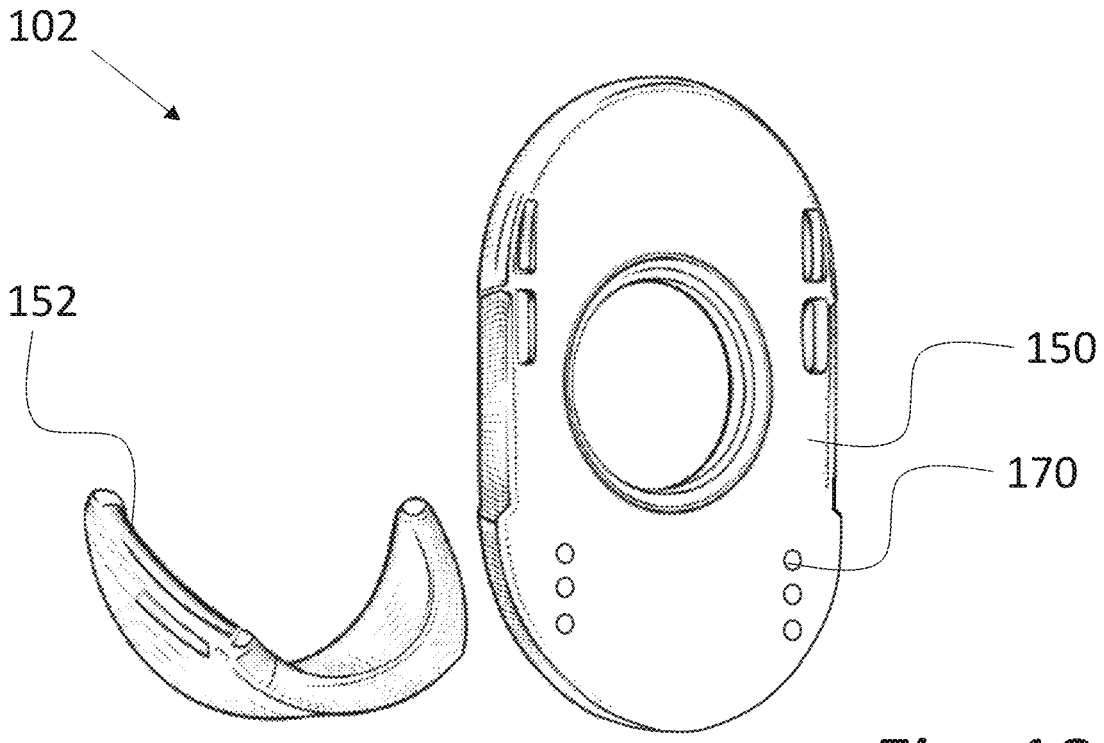
FIG. 13 illustrates the base of a weight loading apparatus having a heel holder removable from a foot rest, according to some embodiments of the present invention.

FIG. 13 illustrates the base of a weight loading apparatus having a heel holder removable from a foot rest, according to some embodiments of the present invention.

In some embodiments of the present invention, the heel holder 152 is removably joined to the foot rest 150. For example, the foot rest may include one or more perforations 170, while the heel holder may include one or more extensions (not shown) aligned with the perforations 170 and configured for being press fit into the perforations to join the heel holder to the foot rest. Other manners of joining the foot rest and heel holder (e.g. via scews and nuts or other retaining unit) are part of the present invention.

In some embodiments of the present invention, the position of the heel holder 152 along the foot rest can be changed. For example, the foot rest 150 may have a plurality of pairs of perforations 170 located at respective locations along the foot rest, while the heel holder has a pair of extensions. The pair of extensions can be fitted into and out of any of the pairs of perforation. In this manner, the heel holder 152 can be placed at a desired location, so that the distance between the heel holder and the front of the foot rest is adjustable, such that base 102 matches the size of the user's foot.

Figure 14:
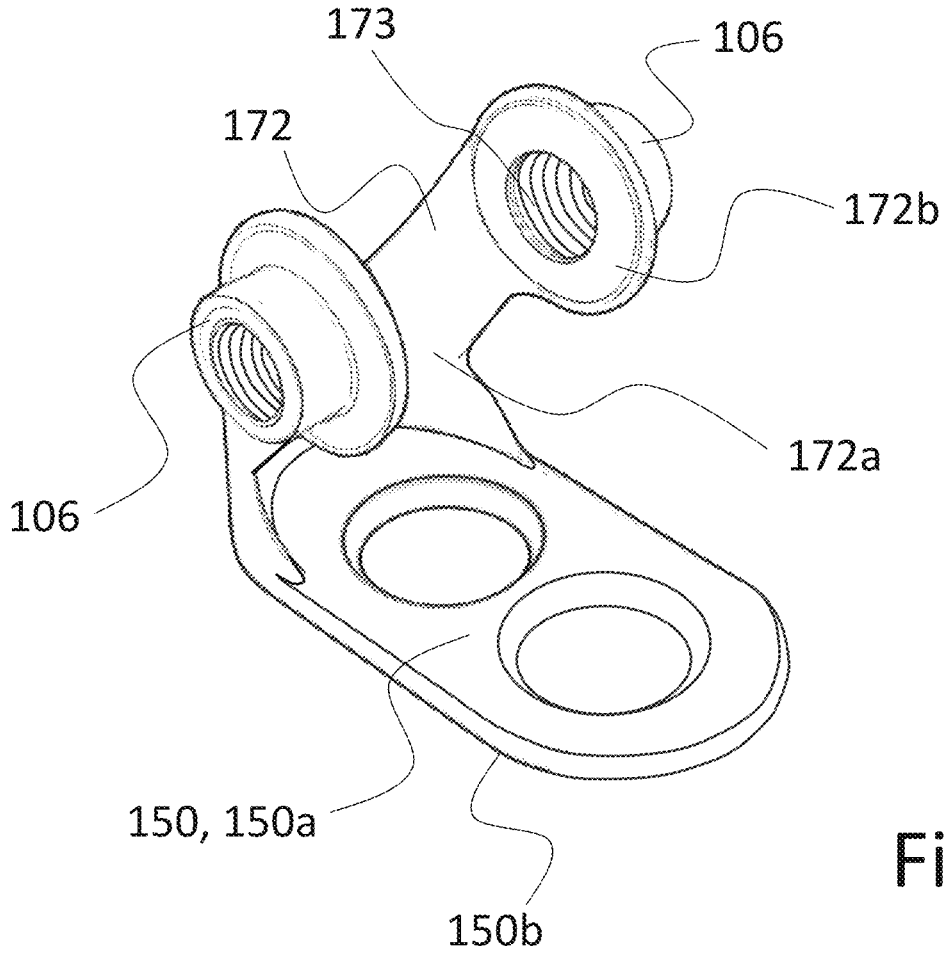
FIG. 14 illustrates a weight loading apparatus comprising two extensions, each joined to a respective rod, according to some embodiments of the present invention.
Figure 16:
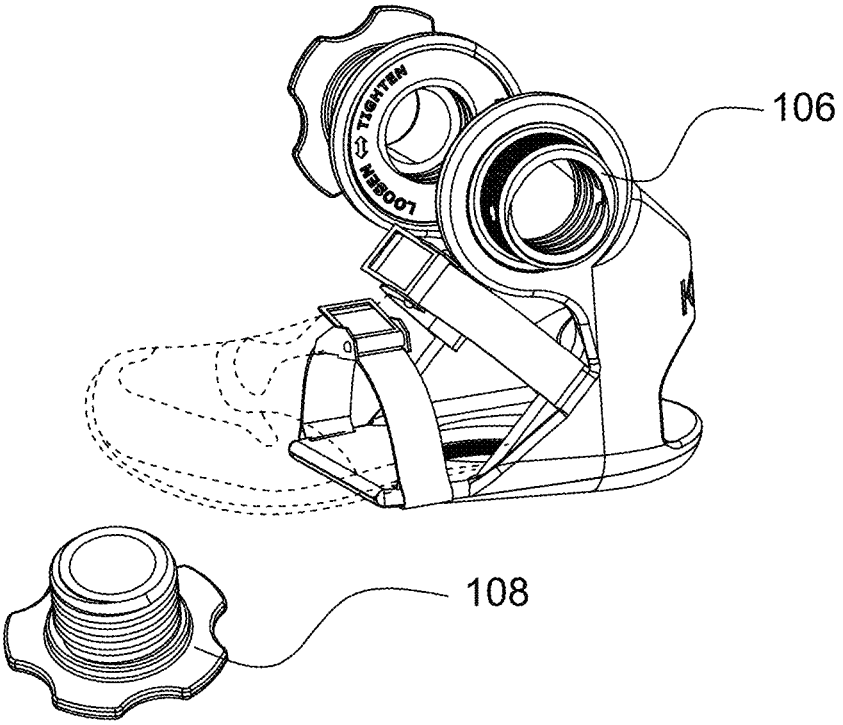
FIG. 16 illustrates the weight loading apparatus of FIG. 14, secured to a shoe, according to some embodiments of the present invention.
Figure 18:
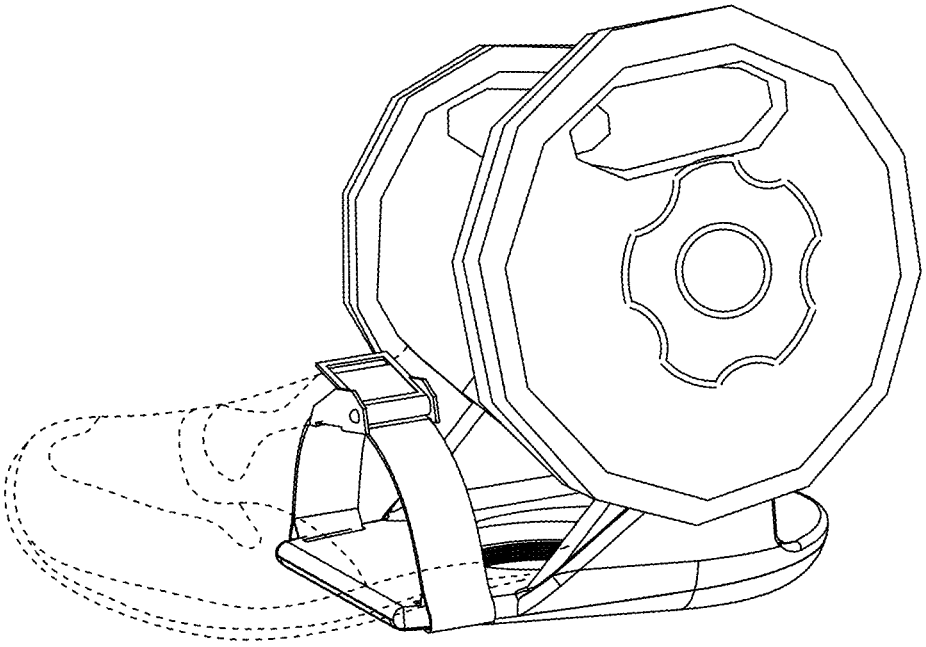
FIG. 18 illustrates the weight loading apparatus of FIGS. 14 and 16 secured to a shoe and joined to weight plates, according to some embodiments of the present invention.

FIG. 14 illustrates a weight loading apparatus comprising two extensions, each joined to a respective rod, according to some embodiments of the present invention. FIG. 16 illustrates the weight loading apparatus of FIG. 14, secured to a shoe, according to some embodiments of the present invention. FIG. 18 illustrates the weight loading apparatus of FIGS. 14 and 16 secured to a shoe and joined to weight plates, according to some embodiments of the present invention.

In some embodiments of the present invention, the foot rest of 150 of base 102 has an upper surface 150*a* and a lower surface 150*b*. The upper surface 150 is configured to face the foot of the user when the apparatus is worn by the user.

The base comprises at least one extension 172 extending upward from the base 102. In some embodiments of the present invention, a pair of extensions 172 is present. Each extension 172 has a first end 172*a* joined to the base and a second end 172*b* located above base, such that when the apparatus is worn, the second ends are located at opposite sides of an ankle of the user.

The rod comprises at least two separate rods 106, each of the separate rods being joined the second end of a respective second end 172*b* and extending outward from the respective hub. The locking unit comprises at least two separate locking units 108 configured to removably lock respective weight plates onto the separate rods 106.

The rods(s) on the extensions(s) may be the only rods, or may be additional rods besides the rods joined to the foot rest of the base (which may be removably or fixedly joined to the foot rest).

In some embodiments of the present invention, the rod(s) may be joined to the heel holder. In some embodiments, of the present invention, the extensions are joined to the heel holder.

Figure 15:
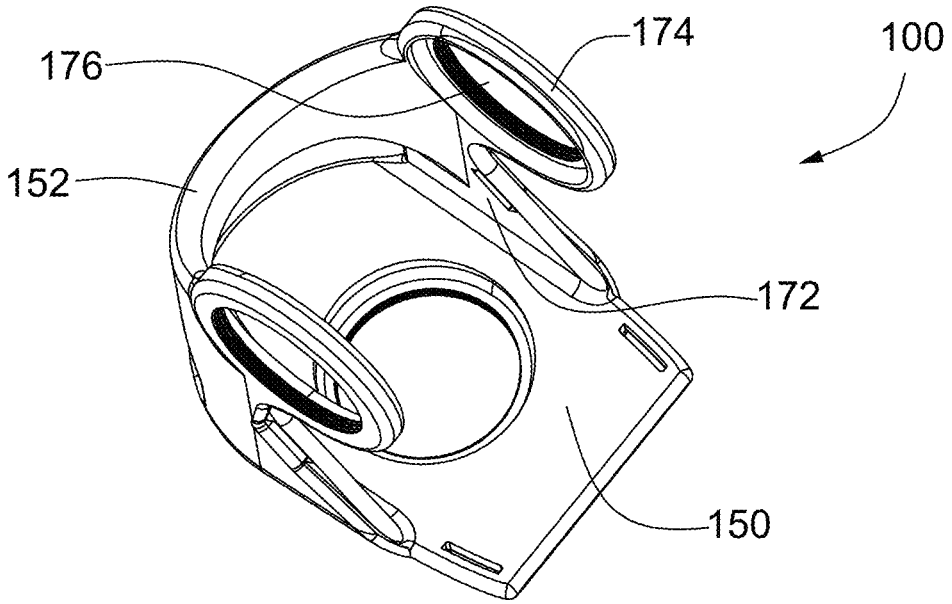
FIG. 15 illustrates a weight loading apparatus comprising two extensions, each ending in a hub configured to be joined to a respective removable rod, according to some embodiments of the present invention.

FIG. 15 illustrates a weight loading apparatus comprising two extensions 172, each ending in a hub 174 configured to be joined to a respective removable rod, according to some embodiments of the present invention.

In some embodiments of the present invention the rods on the extensions the rods are hollow, and have openings 173 at the extensions.

In some embodiments, the hubs 174 have openings 176, configured to be joined to removable rods and locking units in the form of binding bolts and screws, as described above. The extension may extend from any part of the base, be it the foot rest 150 or the heel holder 152.

In some embodiments of the present invention, each of the separate rods is hollow and has first threading in an inner surface thereof—much like the hollow rod in the examples of FIGS. 1 and 2. Similarly to FIGS. 1 and 2, each of the locking units comprises a screw having second threading matching the first threading and a head larger than a perforation of the respective weight plate, such that the screw is configured to enter the hollow rod and lock the weight plate between the base and the head of the screw.

Figure 17:
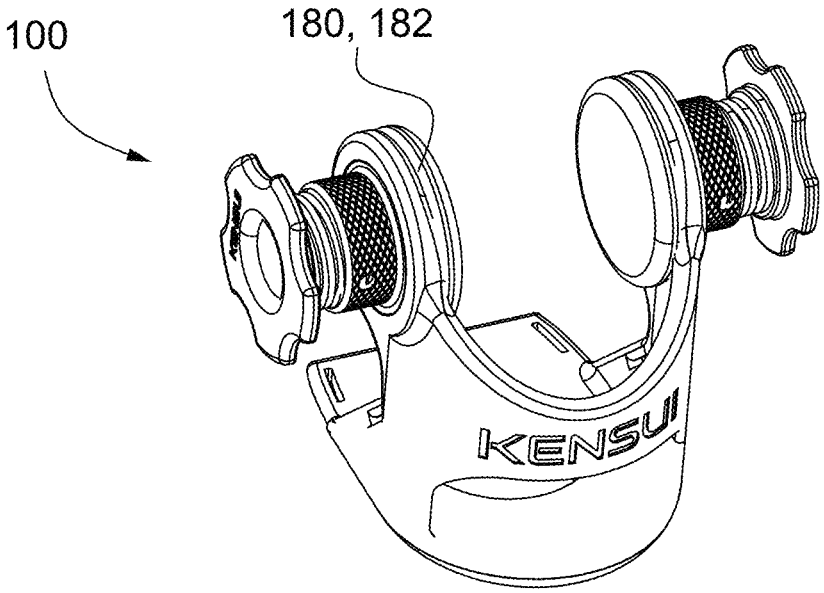
FIG. 17 illustrates a weight loading apparatus with patted caps, according to some embodiments of the present invention.

FIG. 17 illustrates a weight loading apparatus with padded caps, according to some embodiments of the present invention.

In some embodiments of the present invention, the apparatus comprises padded caps 180 configured to be inserted into the openings of the rods at the extension, so that padding 182 of the padded caps faces inwardly from the respective extensions. The padding 182 is configured to contact the ankle of the user, to enhance the comfort of the weight loading apparatus.

Figure 19:
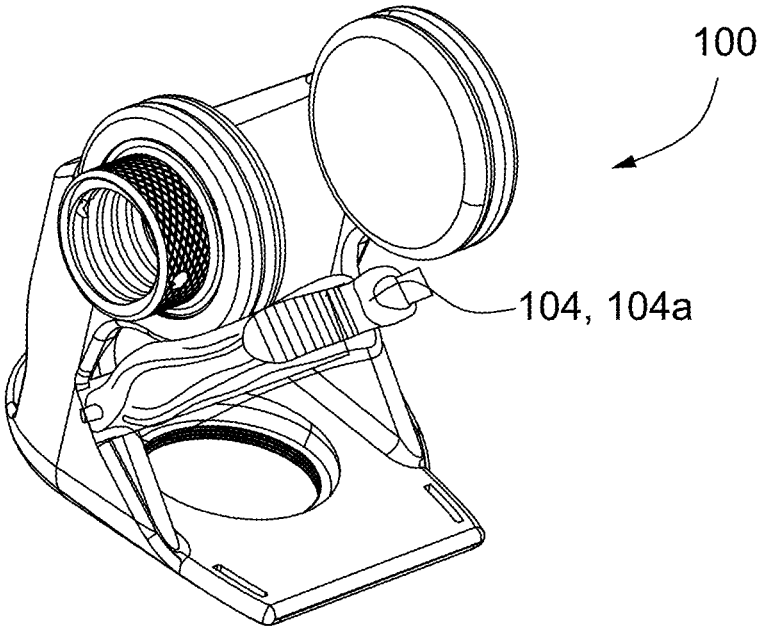
FIG. 19 illustrates a weight loading apparatus with ratchet straps, according to some embodiments of the present invention.

FIG. 19 illustrates a weight loading apparatus 100 with ratchet straps, according to some embodiments of the present invention. The fastener unit 104 may include ratchet straps 104*a*.

Figure 25:
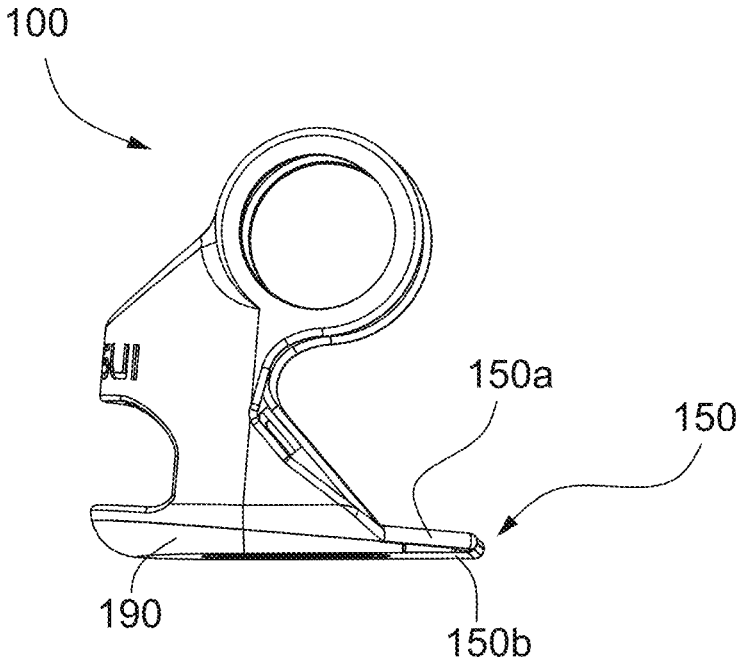
FIG. 25 illustrates the base 102 of a weight loading apparatus with an elastic sole 190.

FIG. 25 illustrates the base 102 of a weight loading apparatus with an elastic coating 190.

In some embodiments, of the present invention, the bottom surface 150*b* of the foot rest 150 include an elastic coating 190 extending under at least some portion of the bottom surface 150*b*. The elastic coating 190 can decrease the chance of the user slipping on or damaging certain surfaces while wearing the weight loading apparatus. The elastic coating 190 may include rubber or other elastic material.

Moreover, the upper surface may be angled with respect to the lowest surface (which may be the bottom surface 150*b*, or the elastic coating 190, if present). If the lowest surface is parallel to the ground, the upper surface slopes downwards from back to front. In this manner, the front of the user's foot or shoe (which may extend forward from the front end of the weight loading apparatus) touches the ground when the user wears the weight loading apparatus.

Figure 20:
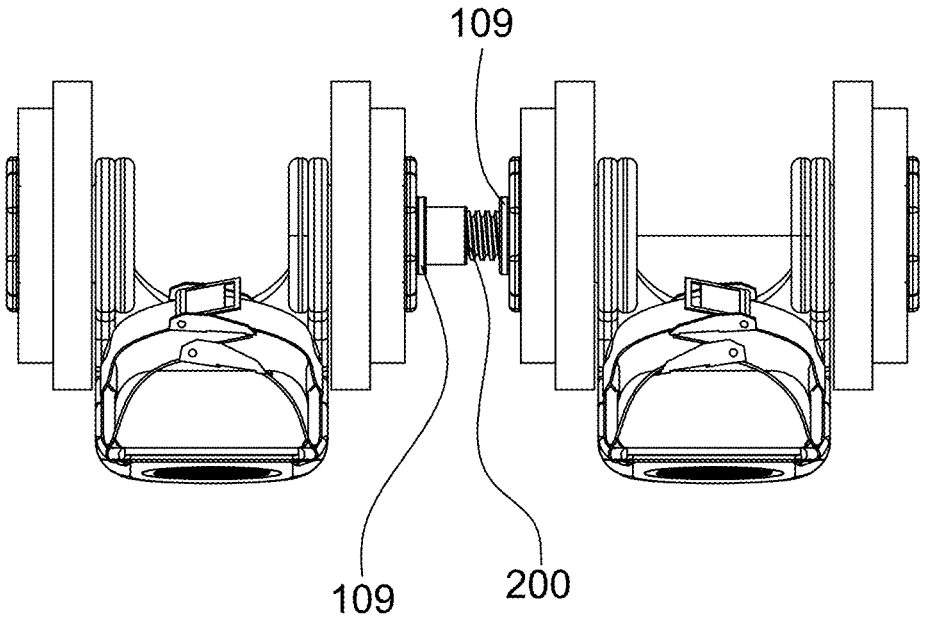
FIG. 20 illustrates a pair of weight loading apparatuses connected by a connector shaft, according to some embodiments of the present invention.
Figure 21:
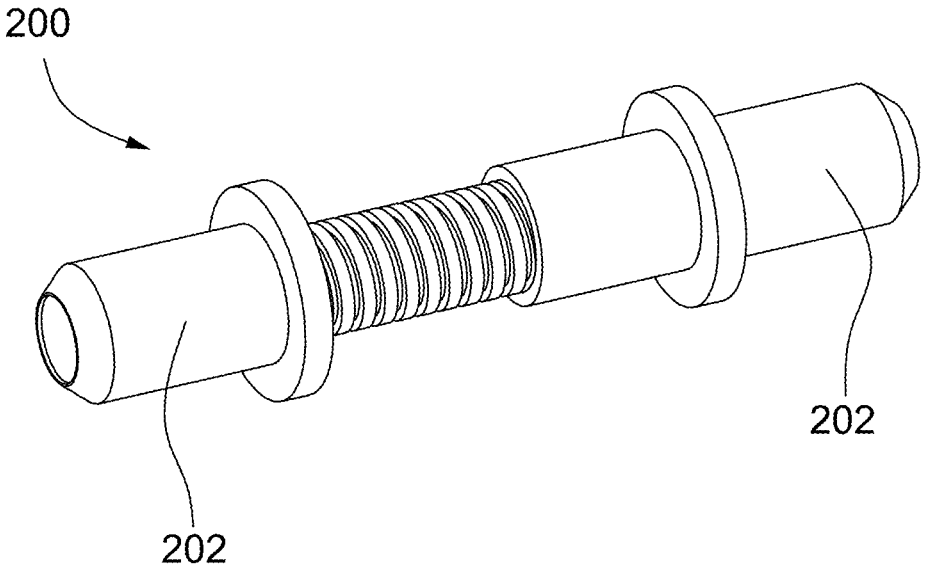
FIG. 21 illustrates an example of a two-piece connector shaft, according to some embodiments of the present invention.
Figure 22:
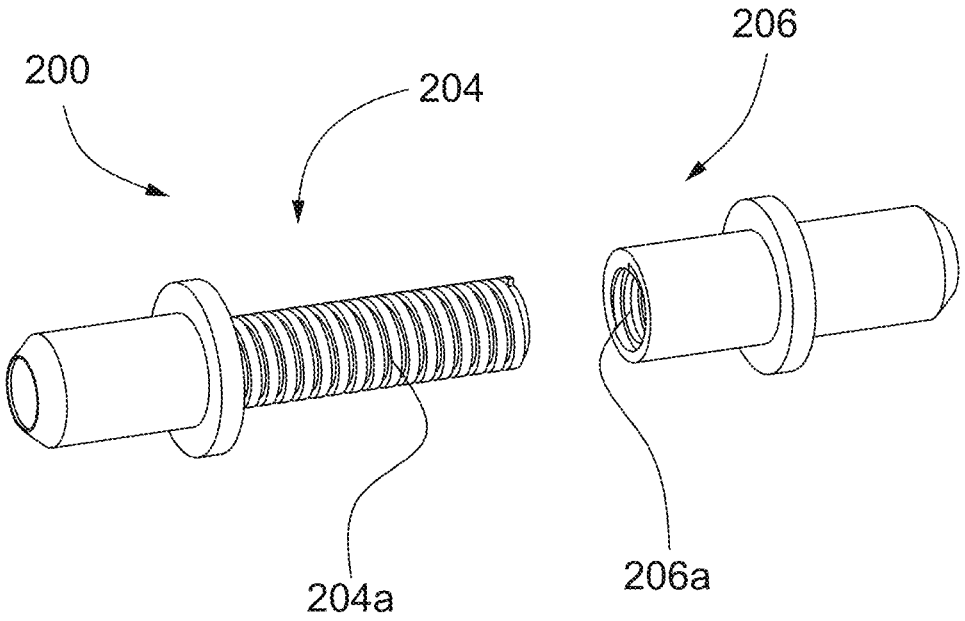
FIG. 22 is an exploded view of the two-piece connector shaft of FIG. 21, according to some embodiments of the present invention.
Figure 23:
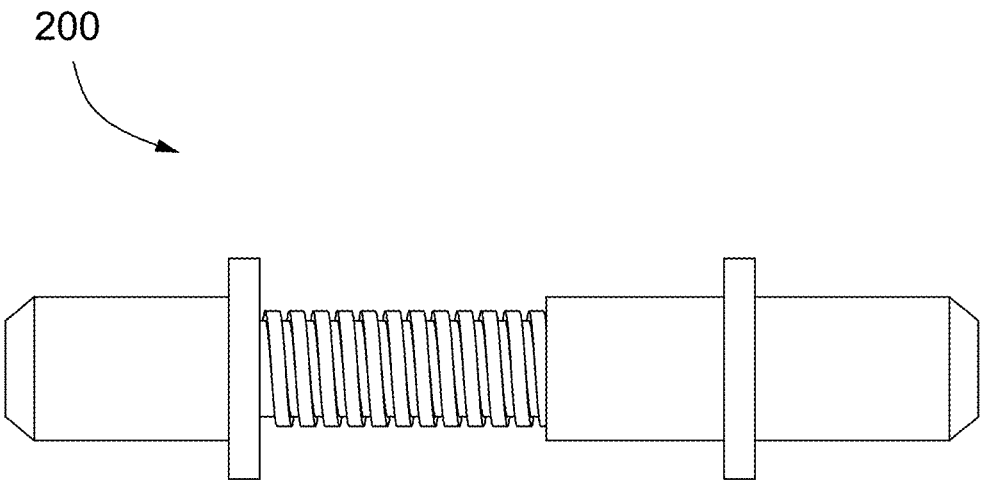
FIG. 23 is a front view of the two-piece connector shaft of FIG. 21 adjusted to have a maximal length, according to some embodiments of the present invention.
Figure 24:
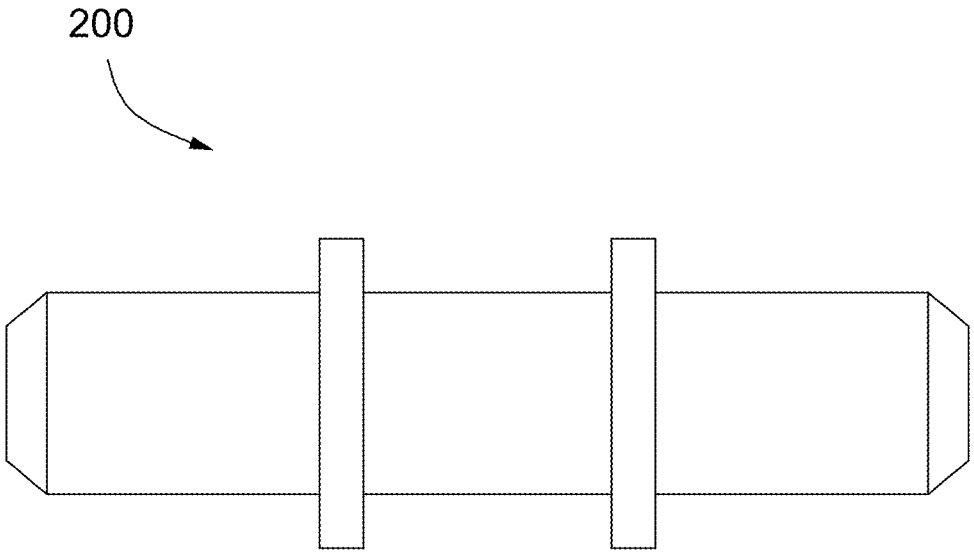
FIG. 24 is a front view of the two-piece connector shaft of FIG. 21 adjusted to have a minimal length, according to some embodiments of the present invention.

FIG. 20 illustrates a pair of weight loading apparatuses connected by a connector shaft, according to some embodiments of the present invention. FIG. 21 illustrates an example of a two-piece connector shaft, according to some embodiments of the present invention. FIG. 22 is an exploded view of the two-piece connector shaft of FIG. 21, according to some embodiments of the present invention. FIG. 23 is a front view of the two-piece connector shaft of FIG. 21 adjusted to have a maximal length, according to some embodiments of the present invention. FIG. 24 is a front view of the two-piece connector shaft of FIG. 21 adjusted to have a minimal length, according to some embodiments of the present invention.

As mentioned above, in some embodiments of the present invention, each of the separate rods is hollow and has first threading in an inner surface thereof, while each of the locking units comprises a screw 109 having second threading matching the first threading and a head larger than a perforation of the respective weight plate, such that the screw is configured to enter the hollow rod and lock the weight plate between the base and the head of the screw.

Each screw 109 may be partially hollow, with an aperture at the screw head.

A connector shaft 200 may be provided to connect the apparatus to a second weight loading apparatus. The connector shaft 200 has two end segments 202, each configured to be inserted into a respective screw head via the aperture on the screw head.

The connector shaft may have an adjustable length. For example, the connector shaft may be telescopic.

The connector shaft 200 may include a first piece 204 and a second piece 206, the first piece being insertable into the second piece and movable with respect to the second piece, to change a length of the connector shaft. In some embodiments of the present invention, the first piece 204 has an out thread 204*a* while the second piece 206 has an inner thread 206*a* cooperating with the outer thread.

Figure 26:
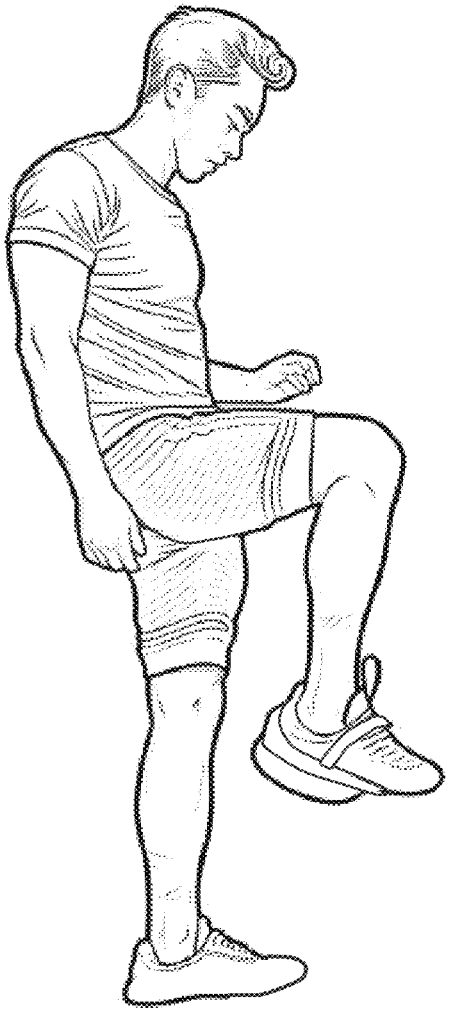
FIGS. 26-28 illustrate examples of exercises that can be performed using the weight loading apparatus, according to some embodiments of the present invention.
Figure 27:
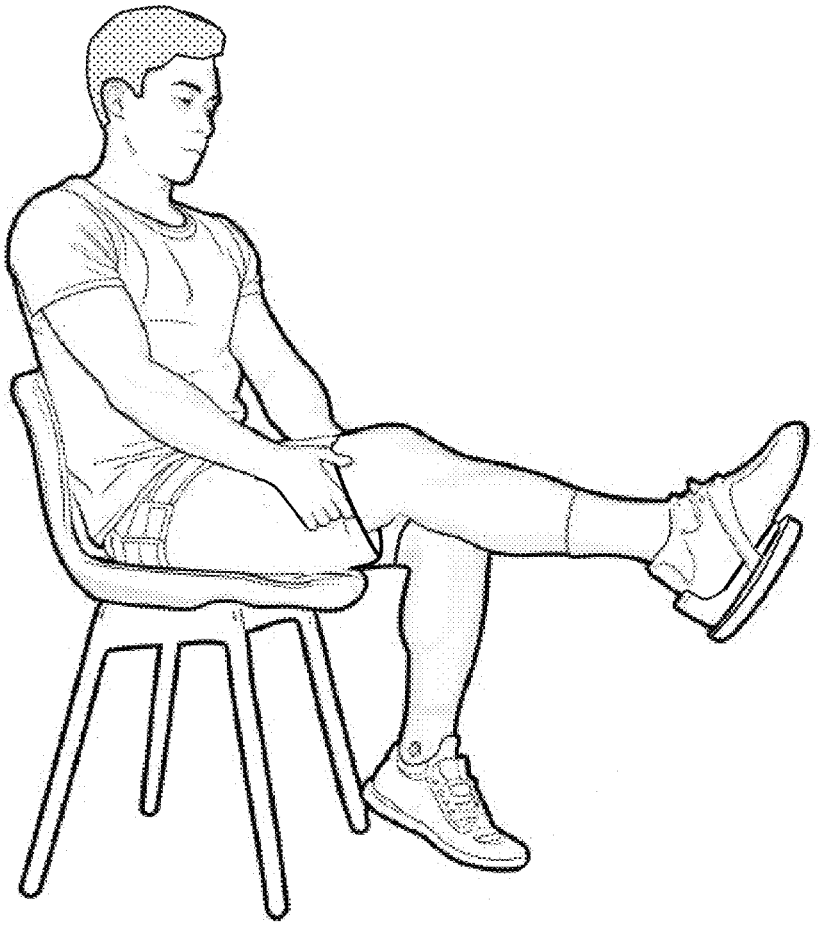
Figure 28:
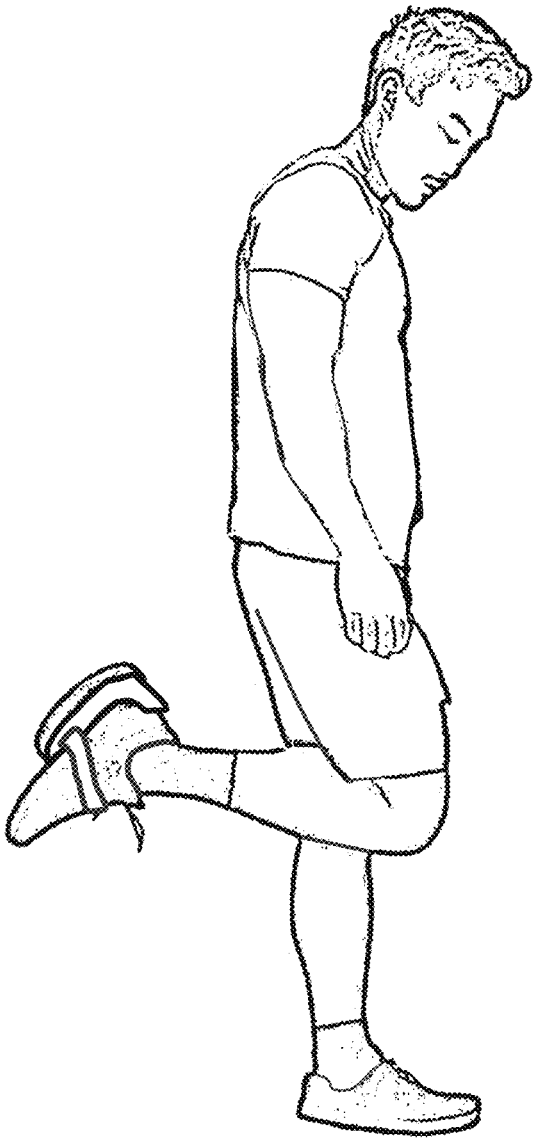

FIGS. 26-28 illustrate examples of exercises that can be performed using the weight loading apparatus, according to some embodiments of the present invention.

In FIG. 26, a leg lift is performed, using a single weight loading apparatus of any of the previous drawings.

In FIG. 27, a leg extension is performed, using a single weight loading apparatus of any of the previous drawings.

In FIG. 28, a leg curl is performed, using a single weight loading apparatus of any of the previous drawings.

Figure 29:
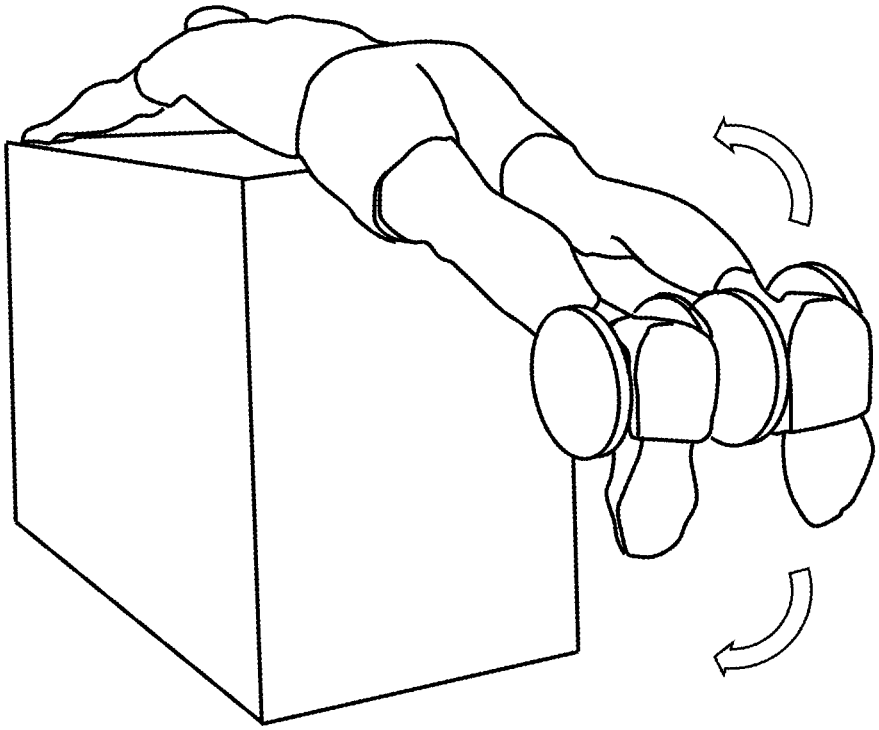
FIGS. 29-31 illustrate examples of exercises that can be performed using a pair of connected weight loading apparatuses, according to some embodiments of the present invention.
Figure 30:
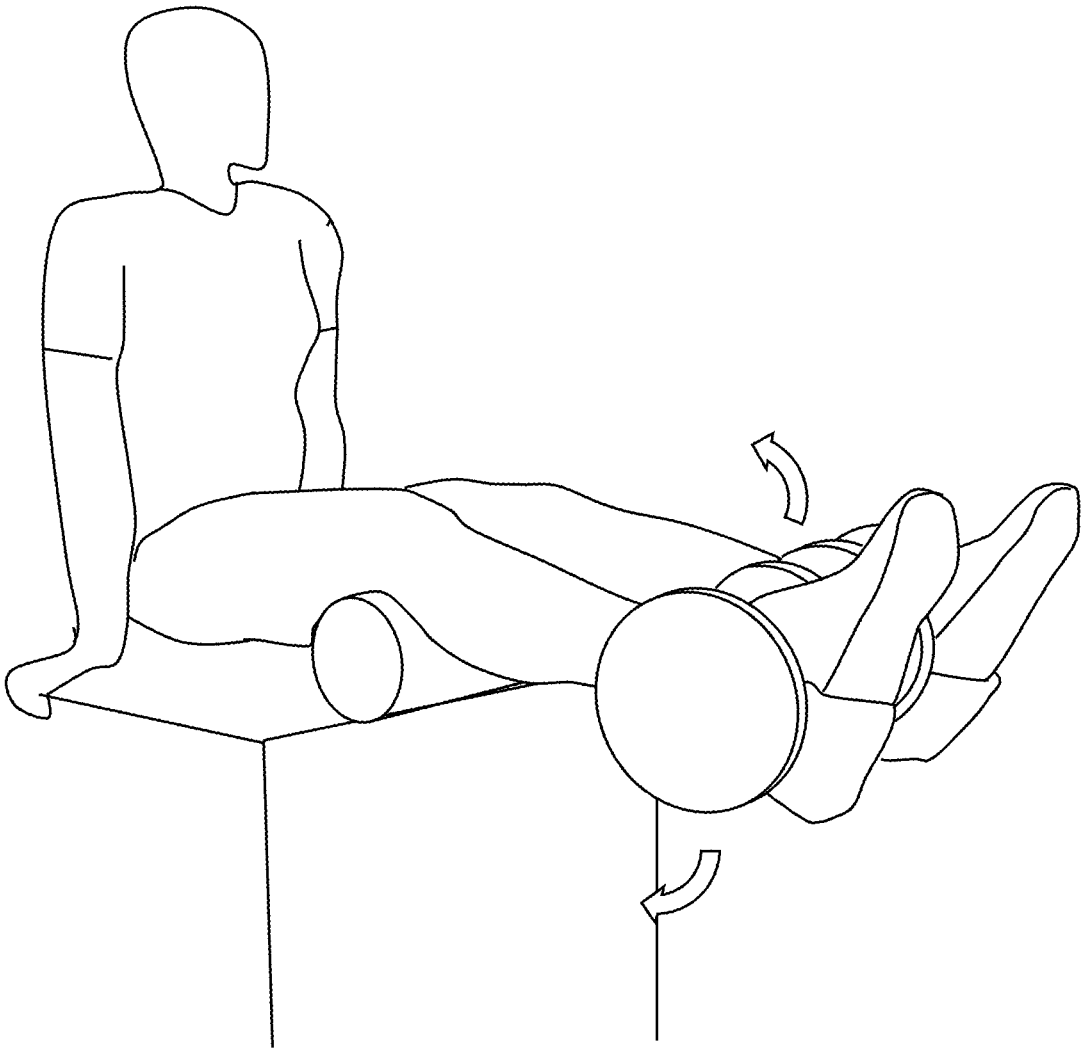
Figure 31:
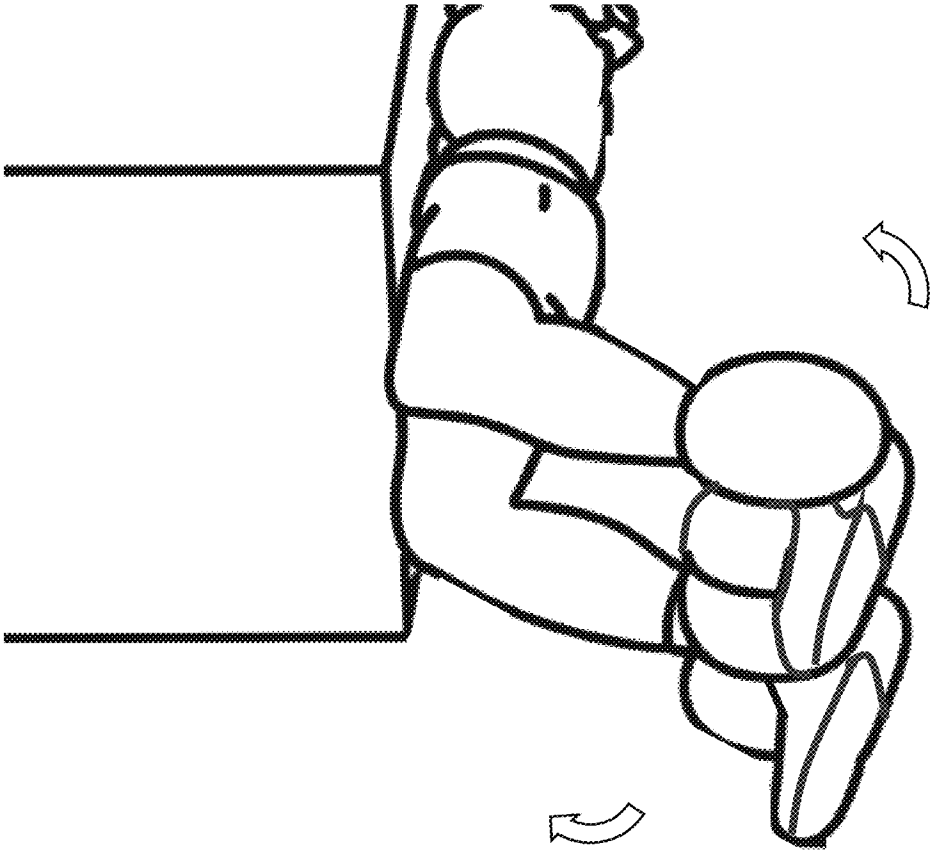

FIGS. 29-31 illustrate examples of exercises that can be performed using a pair of connected weight loading apparatuses, according to some embodiments of the present invention.

In FIG. 29, reverse hypers with both legs are performed. The arrows indicate the motion of the user's feet during the exercise.

In FIG. 30, leg extensions with both legs are performed. The arrows indicate the motion of the user's feet during the exercise.

In FIG. 31, hamstring curls with two legs are performed. The arrows indicate the motion of the user's feet during the exercise.

What is claimed is:

1. A weight loading apparatus, comprising:

a base configured to be placed under a user's foot or footwear, the base having an upper surface and a lower surface, the upper surface being configured to face the foot of the user when the apparatus is worn by the user;

a pair of side extensions extending upward from the base, each extension having a first end joined to the base and a second end located above a foot rest of the base, such that when the apparatus is worn, the second ends are located at opposite sides of an ankle of the user, each of the second ends forming a respective hub;

a fastener unit joined to the base and configured to secure the base to the foot;

two separate rods, each of the separate rods being joined the second end of the respective hub and extending outward from the respective hub; and two separate locking units configured to removably lock respective weight plates onto the separate rods.

2. The apparatus of claim 1, wherein the fastener unit comprises a strap.

3. The apparatus of claim 2, wherein the strap comprises a ratchet strap.

4. The apparatus of claim 1, wherein the rods are fixedly joined to the respective hubs.

5. The apparatus of claim 1, wherein the rods are removably joined to the respective hubs.

6. The apparatus of claim 1, wherein:

the rods are hollow and have openings on hub sides thereof;

the apparatus comprises padded caps configured to be inserted into the openings, so that padding of the padded caps faces inwardly from the respective rod.

7. The apparatus of claim 1, wherein:

each of the separate rods is hollow and has first threading in an inner surface thereof;

each of the locking units comprises a screw having second threading matching the first threading and a head larger than a perforation of a respective weight plate, such that the screw is configured to enter the hollow rod and lock the weight plate between the respective hub and the head of the screw.

* * * * *